US006994125B2

(12) United States Patent
Tröndle et al.

(10) Patent No.: US 6,994,125 B2
(45) Date of Patent: Feb. 7, 2006

(54) FABRICATION OF AIR BAG FABRIC

(75) Inventors: Birgit Tröndle, Albbruck (DE); Michael Becker, Zell im Weisental (DE); Thomas Eschbach, Rheinheim (DE); Norbert Huber, Bad Sackingen (DE)

(73) Assignee: Berger Seiba-Technotex Verwaltungs GmbH & Co., Bad Säckingen (DE)

( * ) Notice: Subject to any disclaimer, the term of this patent is extended or adjusted under 35 U.S.C. 154(b) by 23 days.

(21) Appl. No.: 10/784,640

(22) Filed: Feb. 23, 2004

(65) Prior Publication Data

US 2004/0182468 A1 Sep. 23, 2004

Related U.S. Application Data

(63) Continuation of application No. PCT/EP02/08764, filed on Aug. 6, 2002.

(30) Foreign Application Priority Data

Aug. 30, 2001 (DE) ..... 101 42 130

(51) Int. Cl.
*D03D 11/00* (2006.01)
*B60R 21/16* (2006.01)

(52) U.S. Cl. ..... 139/414; 139/389; 139/384 R; 139/387 R; 280/743.1; 428/166; 428/101; 428/11

(58) Field of Classification Search ..... 139/414, 139/389, 384 R, 387 R, 410; 280/743.1; 428/166, 101, 11
See application file for complete search history.

(56) References Cited

U.S. PATENT DOCUMENTS

| | | | | |
|---|---|---|---|---|
| 5,707,711 | A | | 1/1998 | Kitamura |
| 5,865,464 | A | | 2/1999 | Kanuma et al. |
| 6,220,309 | B1 | * | 4/2001 | Sollars, Jr. ..... 139/389 |
| 6,429,155 | B1 | * | 8/2002 | Li et al. ..... 442/76 |
| 6,451,715 | B2 | * | 9/2002 | Li et al. ..... 442/76 |
| 6,488,311 | B2 | * | 12/2002 | Kato et al. ..... 280/743.1 |
| 6,595,244 | B1 | * | 7/2003 | Sollars, Jr. ..... 139/389 |
| 6,632,754 | B1 | * | 10/2003 | Rose et al. ..... 442/208 |
| 6,672,339 | B2 | * | 1/2004 | Keshavaraj et al. .... 139/383 R |
| 6,698,458 | B1 | * | 3/2004 | Sollars et al. ..... 139/389 |
| 6,701,971 | B1 | * | 3/2004 | Sollars et al. ..... 139/387 R |

FOREIGN PATENT DOCUMENTS

| | | |
|---|---|---|
| EP | 0 687 596 A1 | 12/1995 |
| EP | 1 127 968 A1 | 8/2001 |

OTHER PUBLICATIONS

International Search Report of PCT/EP02/08764 dated May 26, 2003, 5 Sheets.

* cited by examiner

*Primary Examiner*—John J. Calvert
*Assistant Examiner*—Robert H Muromoto, Jr.
(74) *Attorney, Agent, or Firm*—Harness, Dickey & Pierce, P.L.C.

(57) ABSTRACT

A method for weaving fabrics that comprise in at least some sections multiple layers, especially one-piece woven (OPW) airbags comprising single-layer, double-layer and multi-layer sections. Weaves or weave combinations are produced in the double- or multi-layer sections that are different from the plain weave.

5 Claims, 1 Drawing Sheet

FABRICATION OF AIR BAG FABRIC

CROSS REFERENCE TO RELATED APPLICATIONS

This application is a continuation of PCT/EP02/08764, filed Aug. 6, 2002, which claims priority to German Application No. 101 42 130.3, filed Aug. 30, 2001, which are incorporated by reference herein.

BACKGROUND A SUMMARY OF THE INVENTION

The present invention relates to a method of weaving fabrics configured multi-ply in at least some portions, especially air bags woven in one piece (one piece woven=OPW) including an upper ply and a lower ply interwoven into a single ply in a selvage portion.

When fabricating contoured multi-ply wovens, for example one-piece woven (OPW) air bags wrinkles may materialize when configuring several portions differing in the number of fabric plies, for example with inwoven spacers and/or when employing differing materials and/or differing in fineness as a result of the different sets or cover factors in each case in the individual plies of portions in contact with each other. This is due to the differences in the ratio of mass to unit of surface area increasing or diminishing per ply when the existing mass of yarn material is distributed in more or fewer plies than before or when for the same set a coarser yarn, i.e. yarn having a higher mass is employed.

This results in a number of disadvantages. Thus, at the locations or portions as described above crimping the yarns in weaving and shrinkage in subsequent processes may deviate from a fabric surface area free of wrinkles which could result in the specified technical properties failing to be satisfied at such locations. In addition, wrinkle trapping could detriment the strength of the fabric at such locations. Apart from this, the air bag may fail to deploy as specified because of the effect of the wrinkles as cited above which could result in its protection being diminished. Another disadvantage is that the tack of a film laminated to the fabric may suffer from the irregular surface area of the wrinkle portion and the coating as may be provided deviates from that as specified in these portions and/or the tack of the coating may suffer. This too, would result in non-compliance with the technical specification and the product as well as items suffering from the above deficiencies becoming rejects.

It is thus the objective of the invention to propose a method of weaving fabrics configured multi-ply at least in some portions, especially OPW air bags comprising an upper ply and a lower ply in which the disadvantages as known from prior art are avoided or at least greatly diminished. This objective is achieved by a method as set forth in claim 1. Implementing the method in accordance with the invention avoids to advantage wrinkles as the source of numerous deficiencies in the finished product. Differences in the set of the fabric are now compensated by implementing the method in accordance with the invention. Uniform crimp and shrinkage is now attained throughout the air bag in its entirety. The strength of the fabric is no longer reduced by trapped wrinkles in thus enabling performance as specified to be satisfied. The fabric is now engineered to function reliably. As a result of the smooth surface of the OPW fabric attainable by application of the method in accordance with the invention consistent coating of all portions of the air bag or OPW fabric is now assured. The entirety of the air bag surface can now be consistently laminated with a film in ensuring a uniform seal of the OPW fabric. In an early stage in fabrication the weaving method in accordance with the invention prevents air bags becoming rejects because of wrinkles in the finished product.

In one advantageous further embodiment of the method in accordance with the invention a two-ply fabric (12) is woven in a rep mix and a four-ply fabric (14) in L 1/1 plain weave as a particularly advantageous weave combination as an excellent means of preventing wrinkling. It is understood, of course, that such weave combinations also include combinations of other weaves with plain weaves. Further features of the invention read from the sub-claims.

BRIEF DESCRIPTION OF THE DRAWINGS

The invention will now be detailed by way of an example with reference to the drawing in which.

DETAILED DESCRIPTION

Figure 1:
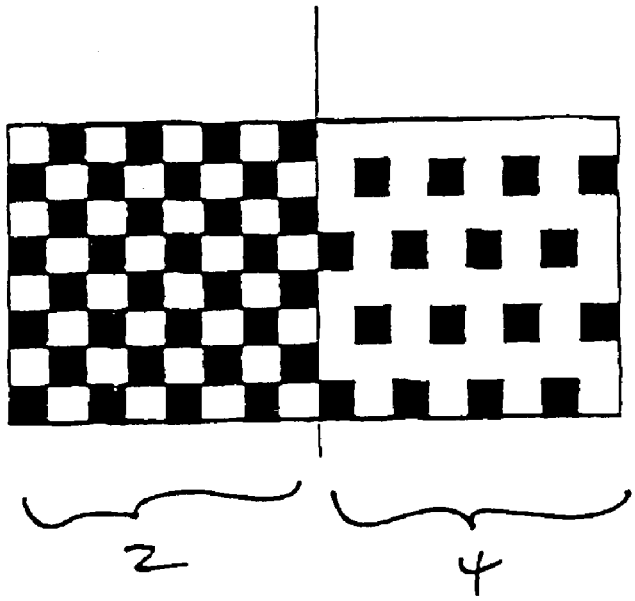
FIG. 1 is an illustration showing the result of a prior art weaving method in interweaving a two-ply portion and a four-ply portion.

Referring now to FIG. 1 there is illustrated the interweave of a two-ply portion 2 and a four-ply portion 4 in an air bag woven by a method as known from prior art in which a plain weave L 1/1 is employed in the two portions 2 and 4 of the fabric as shown. Because of the differences in the set of the fabric of the two portions of this air bag woven as such, the finished product is seriously wrinkled.

Figure 2:
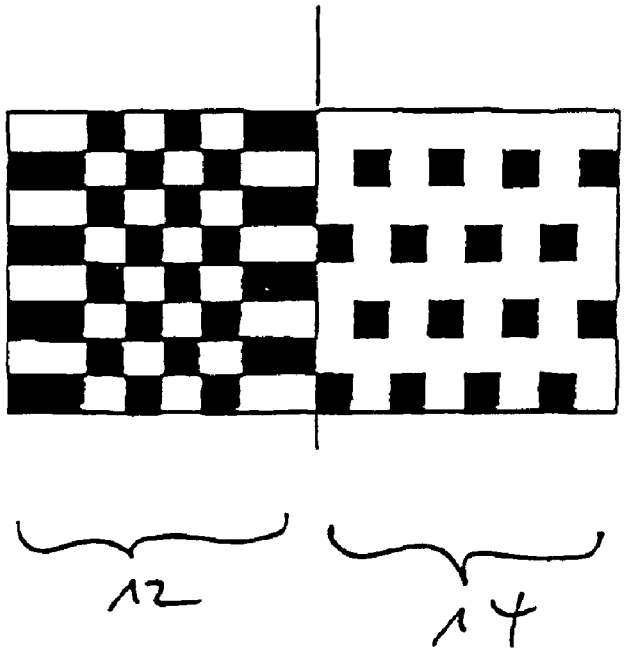
FIG. 2 is an illustration likewise showing two portions of an OPW, but this time with weave combinations as achieved by employing the method in accordance with the invention.

Referring now to FIG. 2 there is illustrated the interweave of a two-ply portion and a four-ply portion in an air bag woven by a method in accordance with the invention. In the two-ply portion 12 shown on the left in FIG. 2 use is made of a combination of a plain weave L 1/1 and a rep weave RL 1/1 in a two-thread configuration whilst in the four-ply portion 14 shown on the right in FIG. 2 use is made of plain weave L 1/1. The fabric as produced by implementing the method in accordance with the invention as shown in FIG. 2 features a uniform set by reducing the set of the two-ply portion 12 in accordance with the invention in thus adapting it to the set of a ply of the four-ply portion 14. By making use of the method in accordance with the invention the reduction in the difference of sets involved results to advantage in the finished product being free of wrinkles so that the OPW air bag can now be put to use with no restrictions.

What is claimed is:

1. A method of weaving fabrics, said fabrics being configured in a multi-ply in at least some portions, said method comprising:

providing a single-ply portion;

providing a two-ply portion;

providing a multi-ply portion; and weaving combination weaves other than a plain weave in at least one of said two-ply and multi-ply portions.

2. A method of weaving fabrics, said fabrics being configured in a multi-ply in at least some portions, said method comprising:

providing a single-ply portion;

providing a two-ply portion;

providing a multi-ply portion;

weaving combination weaves other than a plain weave in at least one of said two-ply and multi-ply portions;

weaving a rep mix being a combination of a plain weave and a rep weave, in said two-ply portion; and weaving a plain weave in said four-ply portion.

3. A method of weaving fabrics, said fabrics being configured in a multi-ply in at least some portions, said method comprising:

providing a single-ply portion;

providing a two-ply portion;

providing a multi-ply portion;

weaving combination weaves other than a plain weave in at least one of said two-ply multi-ply and portions using at least a first thread and a second thread, said first thread and said second thread being different in either material or fineness; and dividing said first thread and said second thread into another number of fabric plies.

4. A method of weaving fabrics, said fabrics being configured in a multi-ply in at least some portions, said method comprising:

providing a single-ply portion;

providing a two-ply portion;

providing a multi-ply portion;

weaving combination weaves other than a plain weave in at least one of said two-ply and multi-ply portions;

weaving a rep mix being a combination of a plain weave and a rep weave, in said two-ply portion; and weaving a plain weave in said four-ply portion, wherein at least one of said combination weaves, rep mix, and plain weave include a first thread and a second thread, said first thread and said second thread are different in either material or fineness; and said first thread and said second thread are divided into another number of fabric plies.

5. An airbag comprising:

a single-ply portion;

a two-ply portion;

a multi-ply portion; and combination weaves other than a plain weave in at least one of said two-ply and multi-ply portions.

* * * * *